US011833833B2

(12) United States Patent
Inaba et al.

(10) Patent No.: US 11,833,833 B2
(45) Date of Patent: Dec. 5, 2023

(54) LIQUID CONTAINER AND LIQUID EJECTION APPARATUS

(71) Applicant: CANON KABUSHIKI KAISHA, Tokyo (JP)

(72) Inventors: Takuro Inaba, Kanagawa (JP); Masatoshi Ohira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 17/716,870

(22) Filed: Apr. 8, 2022

(65) Prior Publication Data

US 2022/0339945 A1 Oct. 27, 2022

(30) Foreign Application Priority Data

Apr. 22, 2021 (JP) ..... 2021-072461

(51) Int. Cl.
*B41J 2/175* (2006.01)

(52) U.S. Cl.
CPC ..... *B41J 2/17523* (2013.01); *B41J 2/17506* (2013.01); *B41J 2/17509* (2013.01)

(58) Field of Classification Search
CPC .... B41J 2/175; B41J 2/17503; B41J 2/17506; B41J 2/17509; B41J 2/17523; B41J 29/13
See application file for complete search history.

(56) References Cited

U.S. PATENT DOCUMENTS

| | | | | |
|---|---|---|---|---|
| 9,914,305 | B2 | 3/2018 | Orihara et al. | B41J 2/17503 |
| 10,093,105 | B2 | 10/2018 | Shimamura et al. | B41J 2/17553 |
| 10,112,403 | B2 | 10/2018 | Ikebe et al. | B41J 2/17553 |
| 10,399,346 | B2 | 9/2019 | Arai et al. | B41J 2/175 |
| 10,399,347 | B2 | 9/2019 | Miyashita et al. | B41J 2/17506 |
| 10,427,412 | B2 | 10/2019 | Okude et al. | B41J 2/03 |
| 10,538,092 | B2 | 1/2020 | Miyashita et al. | B41J 2/17523 |
| 10,611,162 | B2 | 4/2020 | Ikebe et al. | B41J 2/1752 |
| 10,618,300 | B2 | 4/2020 | Shimamura et al. | B41J 2/17553 |
| 10,843,474 | B2 | 11/2020 | Arai et al. | B41J 29/13 |
| 11,192,383 | B2 | 12/2021 | Shimamura et al. | B41J 2/17553 |
| 2012/0013687 | A1 | 1/2012 | Ishizawa et al. | 347/85 |
| 2022/0048295 | A1 | 2/2022 | Shimamura et al. | B41J 29/13 |

FOREIGN PATENT DOCUMENTS

JP 2012-020497 2/2012

OTHER PUBLICATIONS

U.S. Appl. No. 17/722,157, filed Apr. 15, 2022.

*Primary Examiner* — Anh T Vo
(74) *Attorney, Agent, or Firm* — Venable LLP

(57) ABSTRACT

A liquid container includes a container body including a storage chamber configured to store a liquid and a supply port configured to supply the liquid to the storage chamber, and a plug member to seal the supply port, the plug member including a body portion located outside the storage chamber and the supply port and a plug portion located inside the storage chamber and the supply port. The plug portion has a press-fitted portion to be press-fitted into the supply port and a leading end portion exposed to the storage chamber, an axial line of the plug portion is perpendicular to an opening surface of the supply port, and a leading end surface of the leading end portion is an inclined surface inclined with respect to a surface of the plug portion.

11 Claims, 12 Drawing Sheets

LIQUID CONTAINER AND LIQUID EJECTION APPARATUS

BACKGROUND OF THE INVENTION

Field of the Invention

The present invention relates to a liquid container capable of containing a liquid and to a liquid ejection apparatus including the liquid container.

Description of the Related Art

In recent years, a typical liquid ejection apparatus includes a liquid ejection head that ejects a liquid such as a fluid and a liquid container that stores the liquid to be supplied to the liquid ejection head. The liquid in the liquid container is supplied to the liquid ejection head via a tube and a liquid flow path.

Japanese Patent Application Publication No. 2012-20497 discloses a liquid ejection apparatus that injects a liquid from an injection port provided in a large-capacity liquid container into a liquid ejection head, unlike the above-mentioned liquid ejection apparatus that supplies the liquid from the liquid container to the liquid ejection head via the tube and the liquid flow path. The liquid container disclosed in Japanese Patent Application Publication No. 2012-20497 includes the injection port for injecting the liquid and a plug member that prevents leakage of the liquid from the injection port. The plug member is structured to be detachable from the injection port. When the liquid is to be injected, the plug member is detached from the injection port and, otherwise, the plug member is attached to the injection port so as to prevent the liquid from leaking to the outside.

When the liquid is injected into the liquid container, the liquid may adhere to the periphery of the injection port included in the liquid container. When the plug member is attached to the injection port with the liquid adhering to the periphery of the injection port, the liquid adhering to the periphery of the injection port may contaminate the plug member. In addition, when the liquid ejection apparatus is moved with the liquid being stored in the liquid container, due to shaking of the liquid, the liquid in the liquid container may also adhere to the plug member.

The plugs member is press-fitted in the injection port of the liquid container and, when the plug member is detached, a force against a frictional force acting on a press-fitted portion of the plug member is applied to the plug member to detach the plug member.

As a result, due to an impact when the plug member is detached from the injection port, the liquid adhering to the plug member may be scattered to the outside. In addition, after unplugging, the liquid adhering to the plug member may adhere to a hand of a user.

SUMMARY OF THE INVENTION

The present invention has been achieved in view of the problem described above, and an object thereof is to provide a liquid container including a plug member that can reduce a possibility that, when the plug member is detached to open the liquid container, a liquid is scattered or contaminates a hand of a person.

According to an aspect of the present disclosure, it is provided a liquid container including a container body including a storage chamber configured to store a liquid and a supply port configured to supply the liquid to the storage chamber, and a plug member configured to be detachable from the container body so as to seal the supply port, the plug member including a body portion located outside the storage chamber and the supply port in the container body in an attached state where the plug member is attached to the container body and a plug portion located inside the storage chamber and the supply port in the attached state, wherein the plug portion has a press-fitted portion to be press-fitted into the supply port in the attached state and a leading end portion exposed to the storage chamber on a leading end side of the press-fitted portion in the attached state, in the attached state, an axial line of the plug portion is perpendicular to an opening surface of the supply port, and in the attached state, a leading end surface of the leading end portion is an inclined surface inclined with respect to a surface of the plug portion which is perpendicular to the axial line, and the inclined surface is inclined such that a side of the inclined surface located below in a vertical direction protrudes, in a direction of the axial line, from a side of the inclined surface located above in the vertical direction.

According to an aspect of the present disclosure, it is provided a liquid ejection apparatus including a liquid ejection head that ejects a liquid, and the liquid container as described above.

Further features of the present invention will become apparent from the following description of exemplary embodiments with reference to the attached drawings.

DESCRIPTION OF THE EMBODIMENTS

Figure 1:
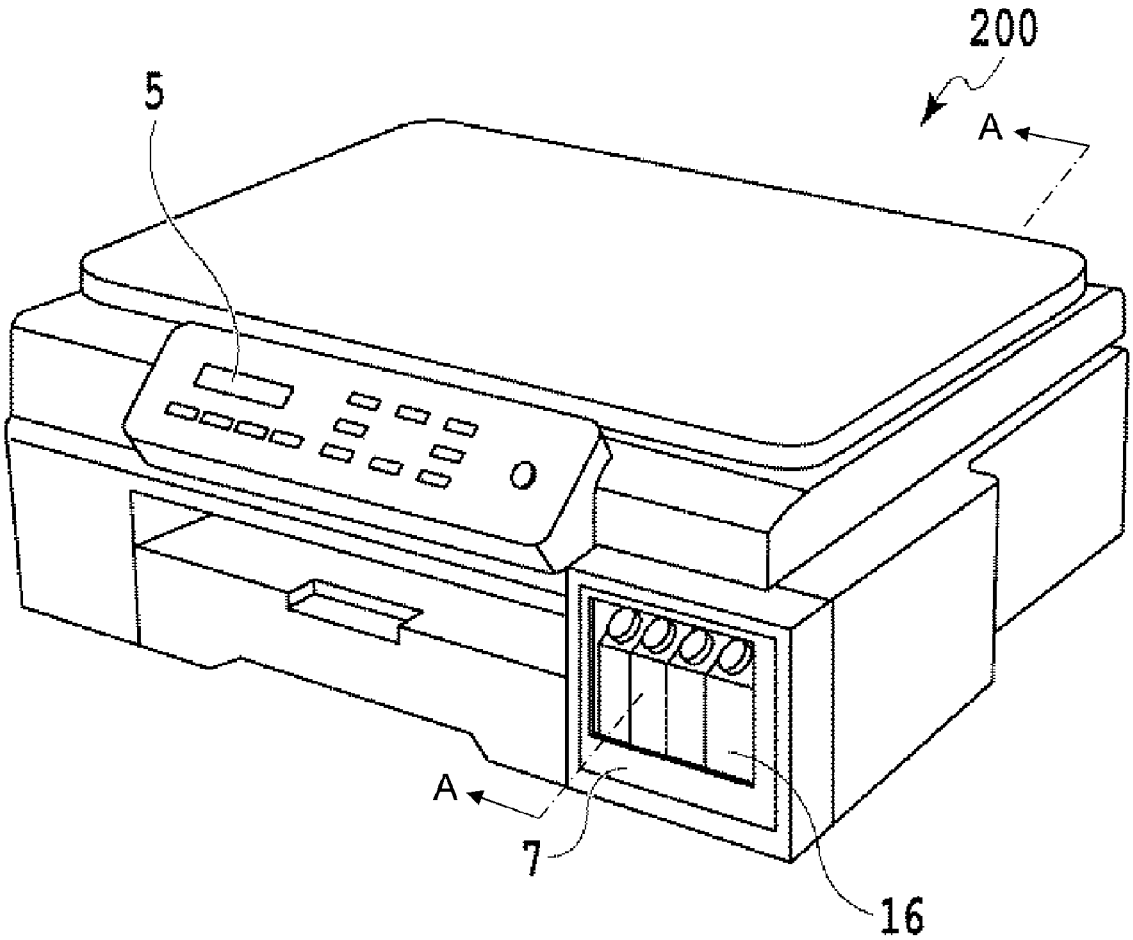
FIG. 1 is a perspective view illustrating a mechanism portion of a liquid ejection apparatus according to a first embodiment.

Referring to the drawings, a description will be given below of preferred embodiments of a technology disclosed in the present application. However, dimensions, materials, shapes, relative positioning, and the like of components described below are to be appropriately changed in accordance with a configuration of an apparatus to which the invention is applied and various conditions, and are therefore not intended to limit the scope of the invention to the following description. Particularly to a configuration or a step not illustrated or stated, a technique well-known or publicly known in the technical field of concern is applicable. In addition, depending on a case, a repeated description may be omitted.

First Embodiment

Figure 2:
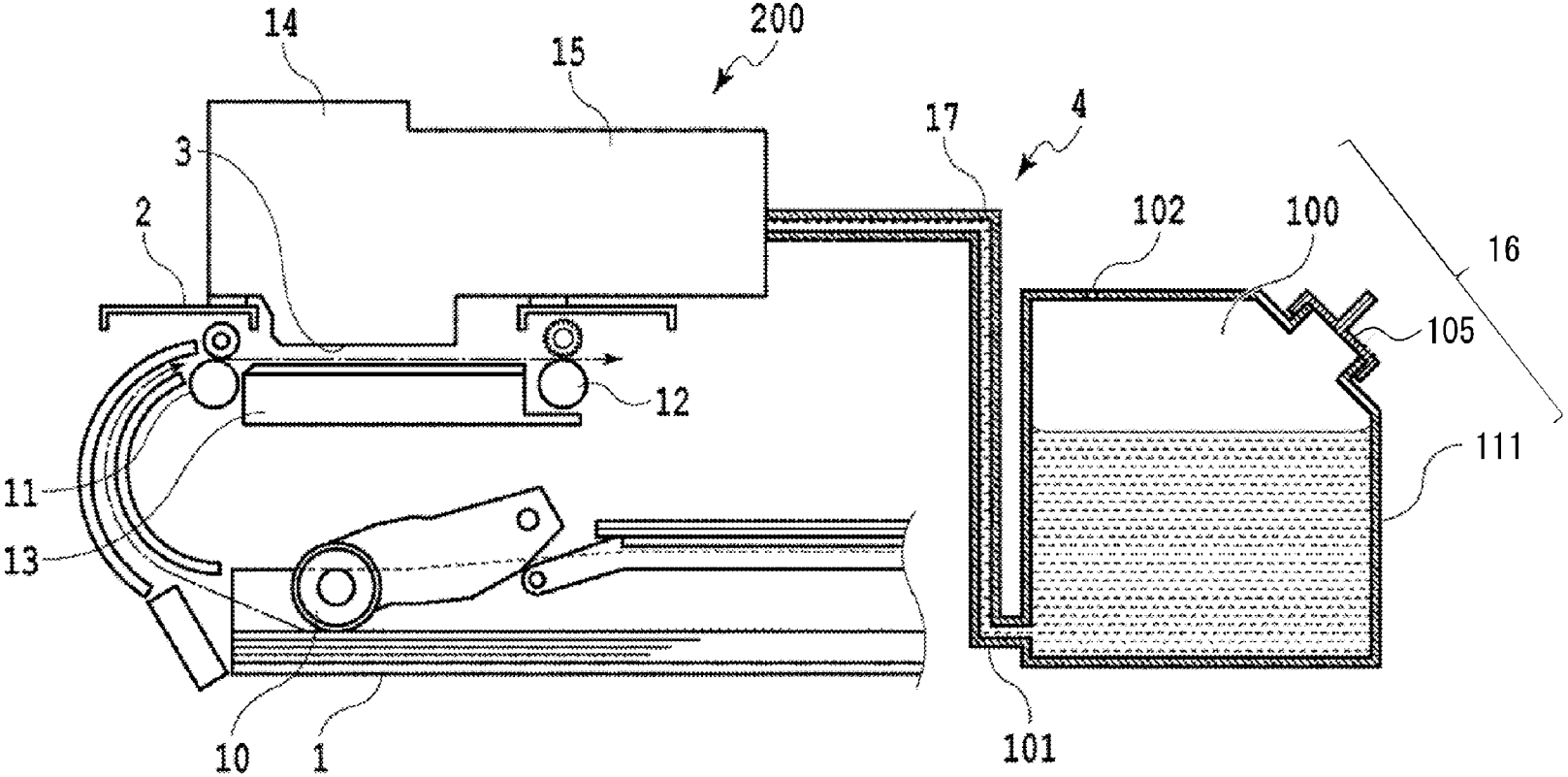
FIG. 2 is a diagram illustrating a cross section of the liquid ejection apparatus according to the first embodiment.

Referring to the drawings, a description will be given of the first embodiment of the present invention. FIG. 1 is a perspective view illustrating a mechanism portion of a liquid ejection apparatus 200 to which the present embodiment is applicable. FIG. 2 is a diagram illustrating a cross section of the liquid ejection apparatus 200 along a line A-A in FIG. 1. Note that, for convenience of description, FIG. 2 illustrates each of members in a different size or omits illustration of the member.

The liquid ejection apparatus 200 includes a feeding unit 1, a transport unit 2, an ejection unit 3, a supply unit 4, and a display unit 5. The feeding unit 1 uses a feed roller 10 to separate each one of sheet-shaped print media from a bundle of the print media and supplies the separated print medium to the transport unit 2. The transport unit 2 includes, between a transport roller 11 and a sheet discharge roller 12, a platen 13 provided on a side downstream of the feeding unit 1 in a transport direction to hold the print medium. The transport unit 2 transports the print medium fed from the feed roller 10 by using the transport roller 11, the sheet discharge roller 12, and the like.

The ejection unit 3 uses a liquid ejection head 15 mounted on a carriage 14 to eject a liquid toward the print medium. The print medium transported by the transport unit 2 is supported by the platen 13 from below in a vertical direction. Then, from the liquid ejection head 15 located above in the vertical direction, the liquid is ejected to form an image based on image information. A liquid container 16 is capable of containing the liquid therein, while the supply unit 4 is configured to be capable of supplying the liquid from a storage chamber (reservoir) 100 of a container body 111 to the liquid ejection head 15 via a flow path 101 and flexible supply tubes 17.

In the present embodiment, the liquid is ink and, more specifically, the four supply tubes 17 through which inks in different colors (black, magenta, cyan, and yellow) flow extend from the liquid container 16 to be connected in a bundled state to the liquid ejection head 15.

When the liquid supplied to the liquid ejection head 15 is ejected from an ejection port of the liquid ejection head 15, the liquid equal in an amount to the ejected liquid is supplied from the liquid container 16 to the liquid ejection head 15. Then, into the liquid container 16, air equal in an amount to the liquid supplied to the liquid ejection head 15 flows from an atmosphere communication port 102 provided above the container body 111 in the vertical direction. The display unit 5 is used to notify a user of a state of the apparatus during an operation or perform display when the user selects among operations.

Figure 3:
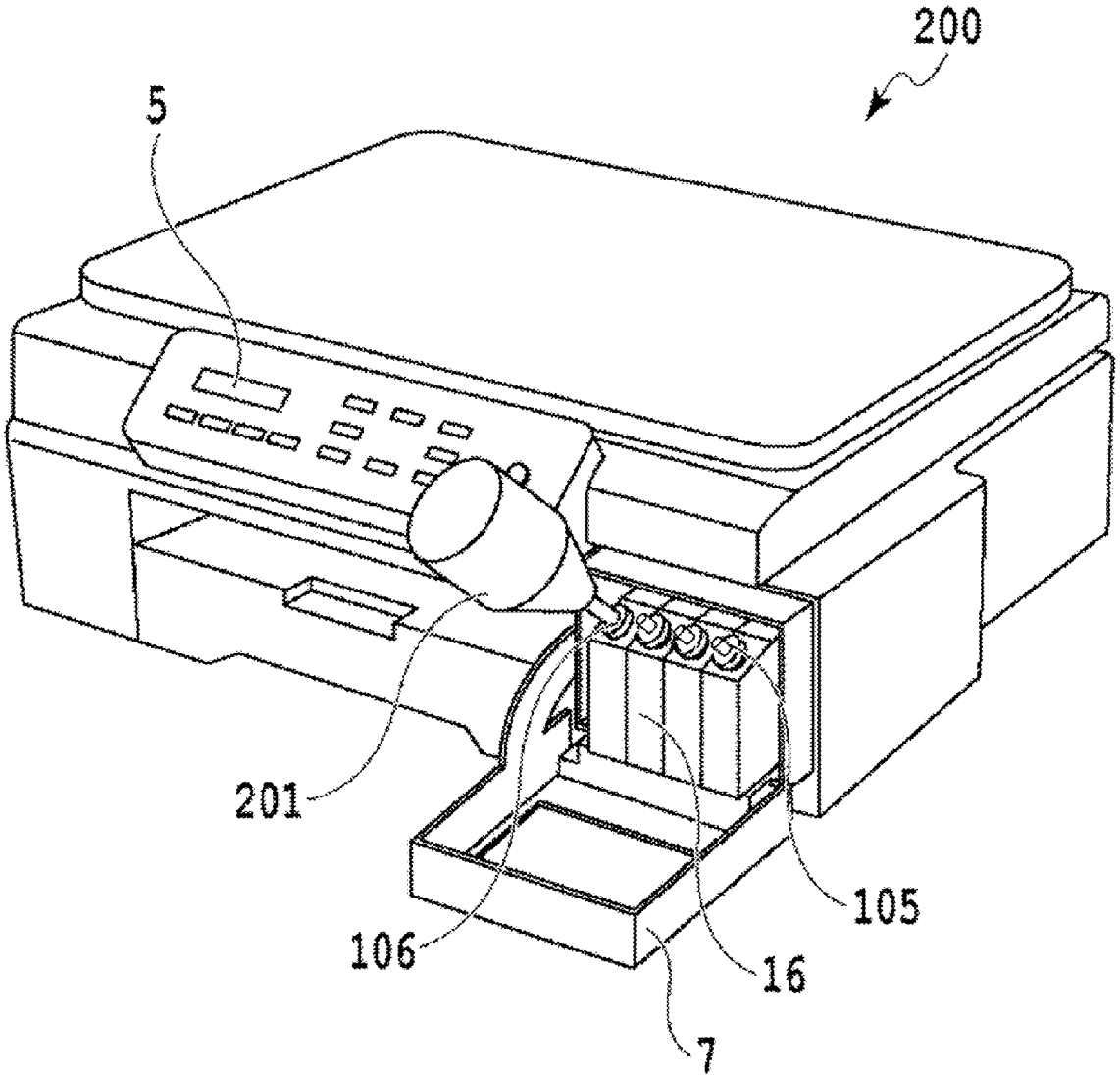
FIG. 3 is a perspective view illustrating the liquid ejection apparatus to be refilled with a liquid in the first embodiment.

FIG. 3 is a perspective view illustrating the liquid ejection apparatus 200 to be refilled with the liquid from a liquid refill container 201. As illustrated in the figure, in the liquid ejection apparatus 200 in the present embodiment, when the liquid is supplied, the user opens a container cover 7 and supplies the liquid from the liquid refill container 201 into the storage chamber 100 via a supply port 106 included in the liquid container 16. To the supply port 106, a plug member 105 configured to be detachable from the container body 111 and seal the supply port 106 is attached. When the storage chamber 100 is to be refilled with the liquid from the liquid refill container 201, the user detaches the plug member 105 from the supply port 106. Note that the liquid container 16 is not limited to such a configuration as used in the present embodiment in which the liquid container 16 is embedded in an apparatus main body of the liquid ejection apparatus 200. As long as the liquid can be supplied from the liquid container 16 to the liquid ejection head 15, the liquid container 16 may also be configured to be provided outside the main body of the liquid ejection apparatus 200.

Figure 4:
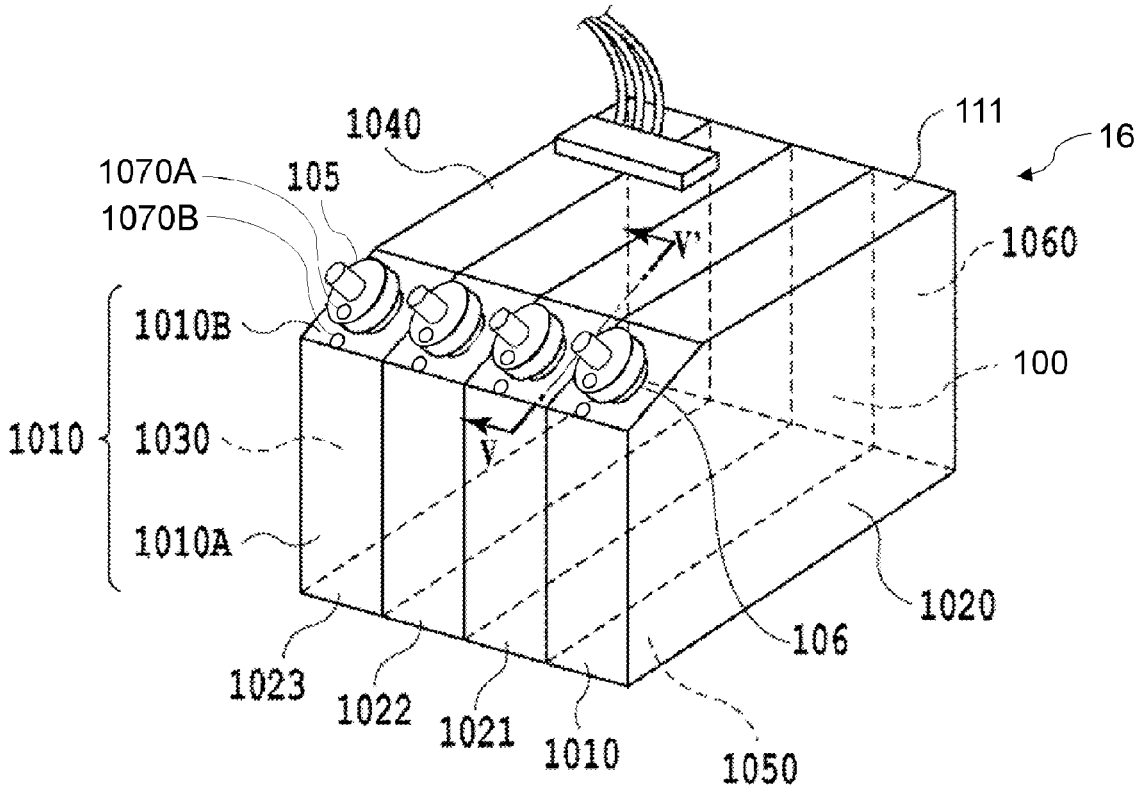
FIG. 4 is a perspective view illustrating a liquid container of the liquid ejection apparatus according to the first embodiment.

FIG. 4 is a perspective view illustrating the liquid container 16 of the liquid ejection apparatus 200. The liquid container 16 in the present embodiment includes the container body 111 including the storage chamber 100 and the supply port 106, and the plug member 105. The container body 111 is molded from a synthetic resin such as polypropylene and has a substantially cuboid outer shape. The container body 111 has a front wall 1010, a right wall 1020, a left wall 1030, an upper wall 1040, and a lower wall 1050. The front wall 1010 includes an upright wall 1010A extending from the lower wall 1050 in a substantially up-down direction and an inclined wall 1010B (an example of an outer wall) connected to an upper end of the upright wall 1010A and inclined with respect to each of the up-down direction and a front-rear direction. The inclined wall 1010B is inclined on a rear side of the upright wall 1010A and formed with the supply ports 106 for the liquid.

Meanwhile, a rear surface of the container body 111 is open. Then, a film 1060 is welded to respective rear end portions of the right wall 1020, the left wall 1030, color separation walls 1021, 1022, and 1023, the upper wall 1040, and the lower wall 1050 to seal the container body 111 and form a rear wall corresponding to the rear surface. In other words, the film 1060 forms the rear wall of the container body 111. Of the configuration described above, the storage chamber 100 that stores the liquid is formed.

An upper surface of each of the plug members 105 and each of the inclined walls 1010B have respective marks 1070A and 1070B engraved therein. The engraved marks 1070A and 1070B function as indices for aligning a direction of each of the plug members 105 when the user closes the supply port provided in the inclined wall 1010B with the plug member 105. Note that, instead of or in addition to the engraved marks 1070A and 1070B, any marking can be used as long as the marking can be used when the user aligns the direction of the plug member 105. For example, it may be possible to change a color of a portion of the plug member 105, stick a seal thereto, or provide a portion of the plug member 105 and a portion of the supply port 106 with a pair of a depressed portion and a protruding portion that are interengaged with each other.

Figure 5:
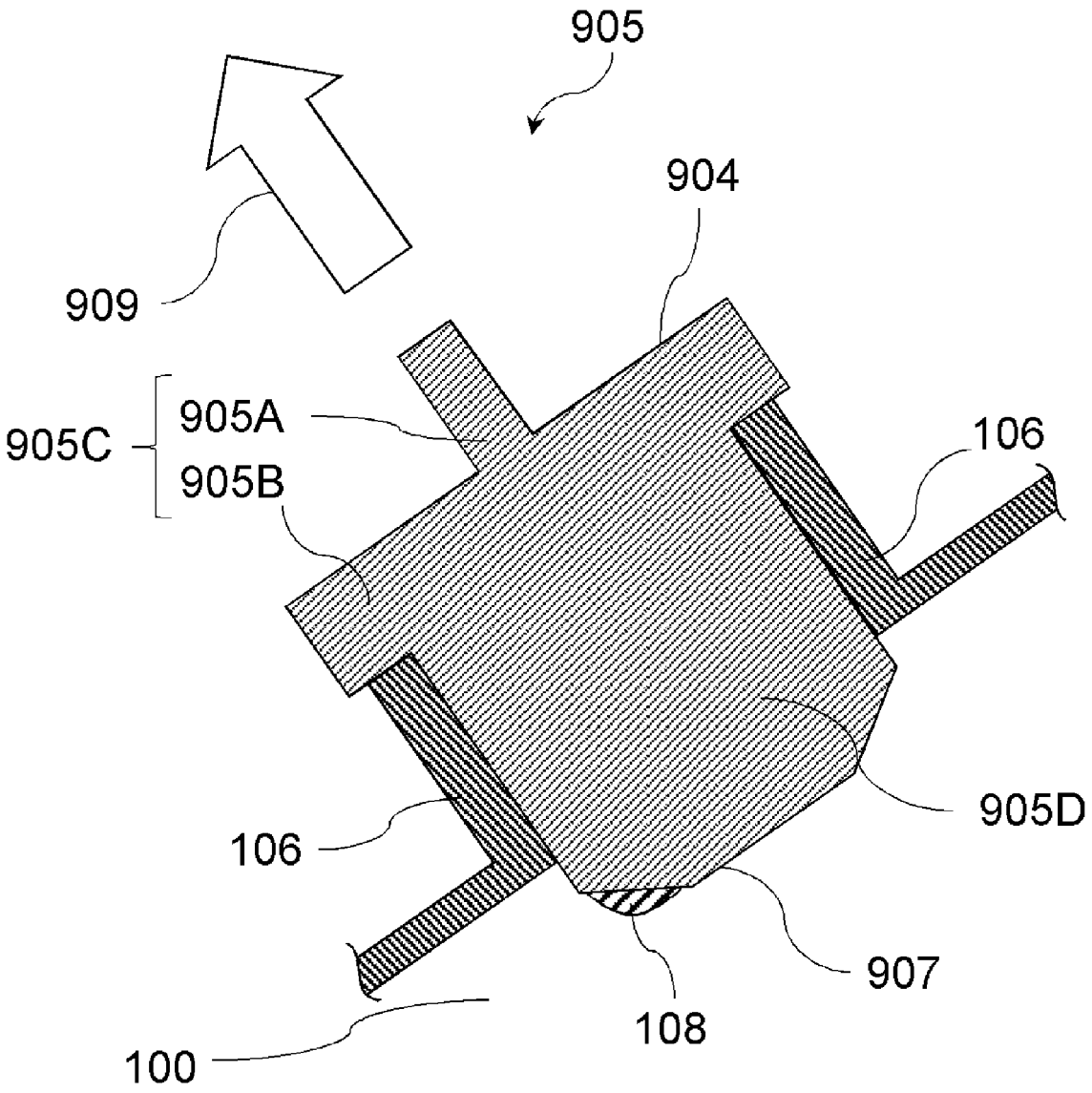
FIG. 5 is a cross-sectional view illustrating a plug member in a comparative example.
Figure 6A:
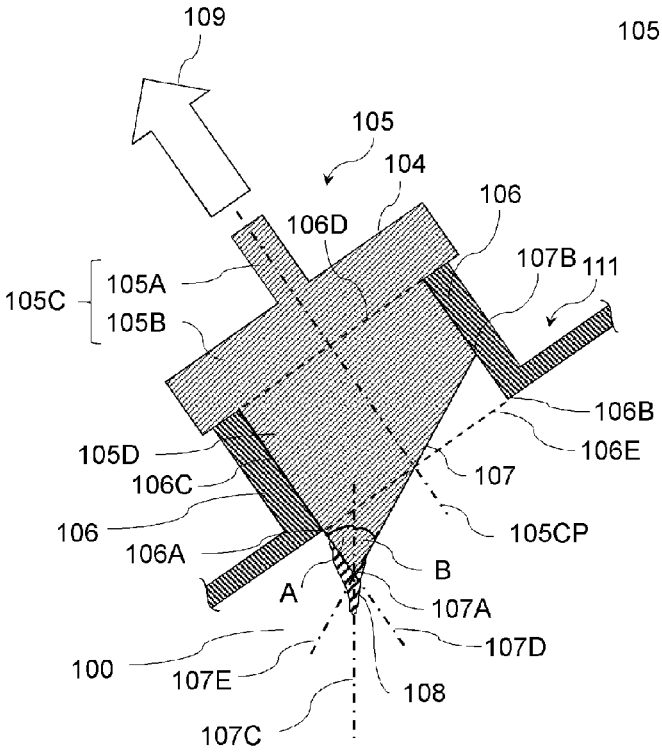
FIGS. 6A to 6C each are a cross-sectional view illustrating a plug member according to the first embodiment.

FIG. 5 is a diagram illustrating a cross section of a plug member 905 in a comparative example, while FIG. 6A is a diagram illustrating a cross section of the plug member 105 in the present embodiment. Note that FIG. 6A is a cross-sectional view of the plug member 105 along a line V-V' in FIG. 4, while FIG. 5 illustrates a cross section of the plug member 905 corresponding to the cross-sectional view in FIG. 6A. FIGS. 6B, 6C, and 8A to 12 also illustrate cross sections of the plug members corresponding to the cross-sectional view in FIG. 6A.

As illustrated in FIG. 5, the plug member 905 includes a body portion 905C located outside the storage chamber 100 and the supply port 106 in an attached state where the plug member 905 is attached to the supply port 106 and a plug portion 905D inserted in the supply port 106 to close the supply port 106. The plug member 905 is attached, while being elastically deformed such that the supply port 106 is held between jutting portions of the plug member 905 in the up-down direction. The body portion 905C of the plug member 905 includes a covering portion 905B covering an opening surface of the supply port 106 and a protruding portion 905A protruding from the covering portion. The protruding portion 905A serves also as a knob portion to be picked up by the user when the plug member 905 is to be detached from the supply port 106. The user pulls the protruding portion 905A in a direction of an arrow 909 to pull out the plug member 905 from the supply port 106 and thereby open the supply port 106. Note that, in the following description, the protruding portion is referred to also as the "knob portion".

As illustrated in FIG. 5, the knob portion 905A is formed so as to protrude from an upper surface 904 of the covering portion 905B extending along the opening surface of the supply port 106 in a state where the plug member 905 is attached to the supply port 106.

In a case where a back surface 907 of the plug member 905 in the comparative example is substantially horizontal with respect to the opening surface of the supply port 106, when ink 108 has adhered to the back surface 907, the ink 108 is likely to drip when the user pulls out the plug member 905 from the supply port 106. Consequently, the dripped ink 108 may adhere to a finger of the user or the like.

Figure 7:
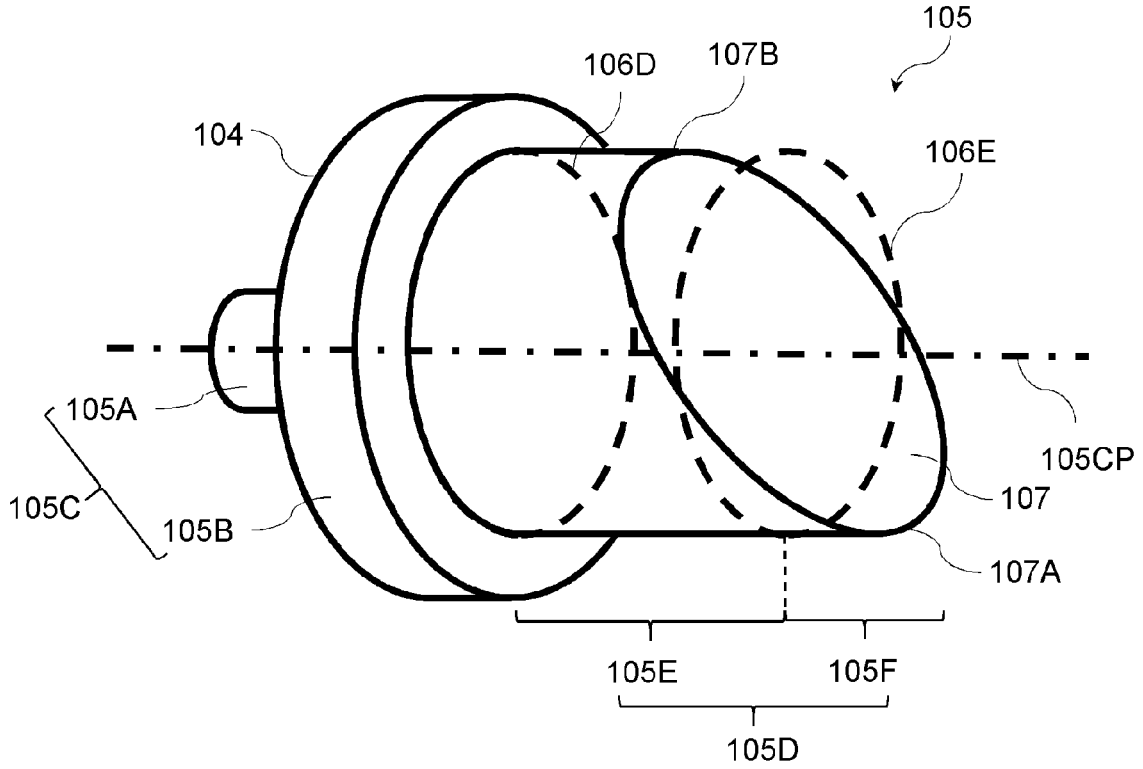
FIG. 7 is a perspective view illustrating the plug member according to the first embodiment.

To prevent this, the plug member 105 in the present embodiment has a configuration in which, in the cross section illustrated in FIG. 6A, a back surface 107 is provided to be inclined from one inner peripheral surface of the supply port 106 toward another inner peripheral surface of the supply port 106. FIG. 7 illustrates a perspective view of the plug member 105 in a state where the supply port 106 is closed with the plug member 105, as illustrated in FIG. 6A. As illustrated in FIGS. 6A and 7, a knob portion 105A protrudes from an upper surface 104. Note that a state where the knob portion 105A "protrudes" refers to a state where the knob portion 105A protrudes from the upper surface 104 to an extent that allows the user to pick up the knob portion 105A or apply a force to the knob portion 105A.

An axial line 105CP of the plug member 105 is a straight line extending through a center of a plug portion 105D described below when viewed from the opening surface of the supply port 106. As illustrated in FIG. 6A, the supply port 106 is formed of an outer opening 106D open to the outside of the container body 111, an inner opening 106E open to the storage chamber 100, and an inner peripheral surface 106C connecting the outer opening 106D and the inner opening 106E. Note that an opening surface having the outer opening 106D of the supply port 106 and an opening surface having the inner opening 106E of the supply port 106 correspond to the opening surface of the supply port perpendicular to the axial line 105CP.

Referring to FIGS. 6A and 7, a further description will be given of the plug member 105. In an attached state where the plug member 105 is attached to the container body 111 so as to seal the supply port 106, the plug member 105 includes a body portion 105C including the knob portion 105A located outside the storage chamber 100 and the supply port 106 of the container body 111 and a covering portion 105B. The covering portion 105B comes into contact with an edge portion of the outer opening 106D of the supply port 106. In addition, the plug member 105 includes the plug portion 105D to be inserted into the supply port 106. As illustrated in FIG. 7, the plug portion 105D is a member having a substantially cylindrical shape. The plug portion 105D has a press-fitted portion 105E to be press-fitted into the supply port 106 and a leading end portion 105F exposed to the storage chamber 100 on a leading end side of the press-fitted portion 105E.

In the attached state where the plug member 105 is attached to the container body 111, the press-fitted portion 105E indicates a portion of an outer peripheral surface of the plug portion 105D which corresponds to a first region to be press-fitted into the inner peripheral surface 106C of the supply port 106. Meanwhile, in the attached state where the plug member 105 is attached to the container body 111, the leading end portion 105F indicates a portion of the outer peripheral surface of the plug portion 105D which corresponds to a second region to be exposed to the storage chamber 100 on the leading end side of the first region.

In the cross-section in FIG. 6A, when viewed from the axial line 105CP, a gravity direction lowest point 107A of inclination of the back surface 107 serving as a leading end surface of the plug member 105 is located on the same side as that of a gravity direction lowest point 106A at the inner peripheral surface 106C of the supply port 106. Meanwhile, when viewed from the axial line 105CP, a gravity direction highest point 107B of the inclination of the back surface 107 is located on the same side as that of a point 106B corresponding to the gravity direction lowest point 106A at the inner peripheral surface 106C of the supply port 106. In the following description, a gravity direction lowest point of the inclination of the back surface 107 when the plug member 105 is viewed in the cross section illustrated in FIG. 6A is referred to also as a "back surface lowest point", while a gravity direction highest point of the inclination of the back surface 107 is referred to also as a "back surface highest point".

The back surface 107 of the plug member 105 is a surface inclined with respect to a surface of the plug portion 105D perpendicular to the axial line 105CP. The back surface 107 is inclined such that, in the attached state where the plug member 105 is attached to the container body 111, a side thereof (upper surface lowest point) located below in the vertical direction protrudes in a direction of the axial line 105CP from a side thereof (back surface highest point) located above in the vertical direction.

The cross section illustrated in FIG. 6A is a cross section along the vertical direction including the axial line 105CP of the plug portion 105D in the attached state. In this cross section, a first virtual line 107D connecting the back surface lowest point 107A serving as a lowest end point of the back surface 107 serving as the leading end surface and a point of contact with the gravity direction lowest point 106A serving as a lowest end point of the inner opening 106E in the leading end portion 105F is set. In addition, a vertical virtual line 107C extending upward from the back surface lowest point 107A in the vertical direction is set. Then, an angle formed between the first virtual line 107D and the vertical virtual line 107C is assumed to be A. Meanwhile, a second virtual line 107E connecting the back surface lowest point 107A of the back surface 107 and the gravity direction highest point 107B serving as a highest end point of the back surface 107 is set. Then, an angle formed between the second virtual line 107E and the vertical virtual line 107C is assumed to be B. At this time, an inclined shape of the back surface 107 is provided so as to satisfy (Angle A)≥(Angle B). The back surface lowest point 107A is provided to be located below the gravity direction lowest point 106A at the inner peripheral surface 106C of the supply port 106 in the gravity direction.

Also, in the attached state where the plug member 105 is attached to the container body 111, a side of the back surface 107 located below (side with the back surface lowest point 107A) is located on the side of the storage chamber 100 rather than on the side of the inner opening 106E of the supply port 106. Meanwhile, a side of the back surface 107 located above (side with the back surface highest point 107B) is located on the side of the inner peripheral surface 106C of the supply port 106 rather than on the side of the inner opening 106E of the supply port 106.

With the back surface 107 having such an inclined shape, since the inner opening 106E is located below the outer opening 106D as illustrated in FIG. 6A, the ink 108 adhering to the back surface 107 is likely to collect at the back surface lowest point 107A on the gravity direction side of the inclined surface.

Figure 6B:
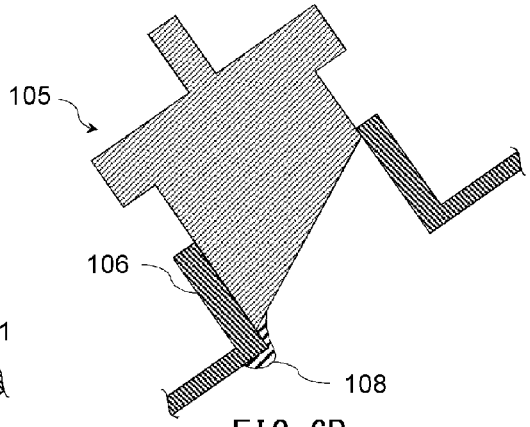
Figure 6C:
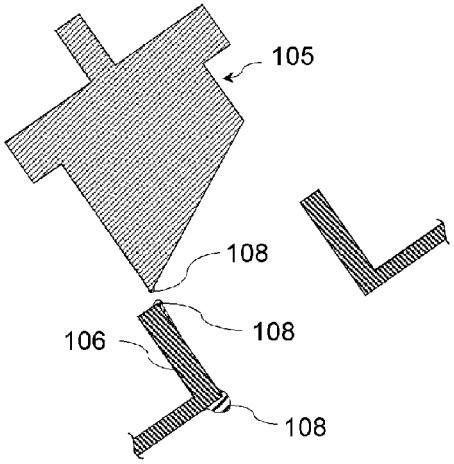

FIGS. 6B and 6C are diagrams sequentially illustrating a process in which the plug member 105 in the state in FIG. 6A is pulled out. In the state in FIG. 6A, when the user pulls the knob portion 105A in a direction of an arrow 109, the plug member 105 begins to be pulled out. At this time, the plug member 105 moves in the direction of the arrow 109 with a side surface of the plug portion 105D rubbing against the inner peripheral surface 106C of the supply port 106. In addition, due to a surface tension between the inner peripheral surface 106C of the supply port 106 and the ink 108 collected at the back surface lowest point 107A, the plug member 105 is gradually pulled out, while the ink 108 adheres stepwise to the inner peripheral surface 106C of the supply port 106 (FIG. 6B).

Then, when the plug member 105 is completely pulled out of the supply port 106, an amount of the ink 108 adhering to the back surface 107 is smaller (FIG. 6C) than that in a plugged state (FIG. 6A). As a result, the plug member 105 can reduce ink scattering and ink dropping when the user pulls out the plug member 105 from the supply port 106.

Note that the inclination of the back surface 107 may also be parallel to the opening surface of the supply port 106. However, as illustrated in FIG. 6A, the back surface 107 is preferably inclined from the opening surface of the supply port 106. By providing the back surface 107 with such an inclination, when the ink 108 has adhered to the back surface 107, the ink 108 drops in the gravity direction to be likely to collect at the back surface lowest point 107A.

In addition, the inclination of the back surface 107 is preferably formed so as to satisfy (Angle A)≥(Angle B). This allows the ink 108 adhering to the surface (back surface 107) (on the angle B side) extending from the back surface highest point 107B to the back surface lowest point 107A to be more likely to exert a force in the gravity direction against the surface tension than the ink 108 adhering to the surface on the angle A side (the side surface of the plug member 105). Consequently, the ink 108 is relatively unevenly concentrated on the surface on the angle A side of the straight line 107C extending through the back surface lowest point 107A in the vertical direction to serve as a boundary. As a result, when the plug member 105 is pulled out, it is possible to more efficiently move the ink 108 adhering to the back surface 107 to the supply port 106 and reduce the amount of the ink adhering to the back surface 107.

Second Embodiment

Next, a description will be given of the second embodiment of the present invention. Note that, in the following description, the same components as those in the first embodiment are given the same reference numerals, and a detailed description thereof is omitted. In the present embodiment, in a cross section illustrated in FIG. 8A, a region of the inner peripheral surface of the supply port 106 located on the back surface lowest point 107A side of the back surface 107 of a plug member 205 according to the present embodiment which is located at least below in the vertical direction is formed with liquid wiping portions 110 each having a depressed shape. The liquid wiping portions 110 are formed on the same side as that with the back surface lowest point 107A when viewed from the axial line 105CP of the plug member 205. Note that, in FIG. 8A, the liquid wiping portions 110 are formed at two positions on the inner peripheral surface of the supply port 106, but it may also be possible that the liquid wiping portion 110 is formed at one position or the liquid wiping portions 110 are formed at a plurality of positions. As will be described below, when the plug member 205 is attached/detached to/from the container body 111, the liquid wiping portions 110 slidably moves against a region of the leading end portion 105F of the plug portion 105D in the attached state which is located on the side of the storage chamber 100 rather than on the side of the supply port 106 to wipe off the liquid.

Each of the liquid wiping portions 110 can be formed by cutting, after the container body 111 is molded, the inner peripheral surface of the supply port 106. Alternatively, each of the liquid wiping portions 110 can also be formed by, e.g., molding the supply port 106 as two parts obtained by dividing the container body 111 when viewed from above in the vertical direction and joining together the individual parts by secondary molding.

As long as the liquid adhering to the leading end portion 105F of the plug portion 105D can be wiped off, a range in which the liquid wiping portions 110 are formed in the inner peripheral surface of the supply port 106 can be determined as appropriate. Accordingly, each of the liquid wiping portions 110 may also be formed around the entire periphery of the inner peripheral surface of the supply port 106.

Figure 8A:
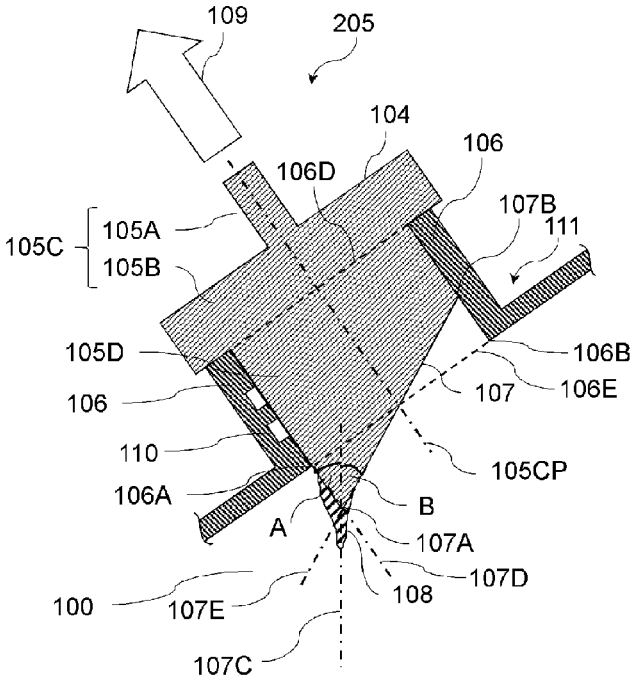
FIGS. 8A to 8C each are a cross-sectional view illustrating a plug member according to a second embodiment.
Figure 8B:
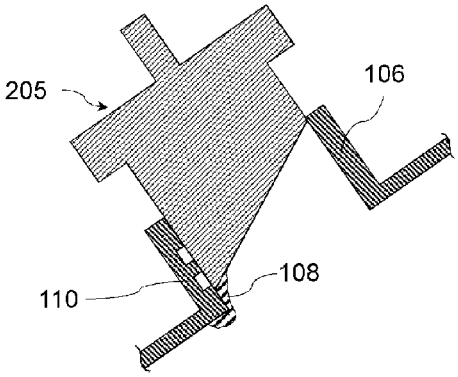
Figure 8C:
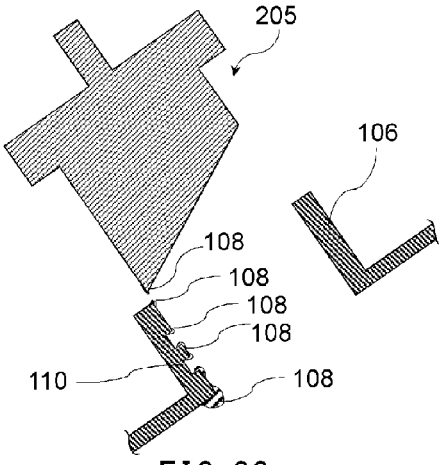

FIGS. 8B and 8C are diagrams sequentially illustrating a process in which the plug member 205 in the state in FIG. 8A is pulled out of the supply port 106, similarly to FIGS. 6B and 6C. In the state in FIG. 8A, when the user pulls the knob portion 105A in the direction of the arrow 109 in the figure, the plug member 205 begins to be pulled out. At this time, the plug member 205 moves in the direction of the arrow 109 with the side surface of the plug portion 105D rubbing against the inner peripheral surface of the supply port 106 and against the liquid wiping portions 110 formed in the inner peripheral surface. Since the plug member 205 is attached to the supply port 106 while being elastically deformed, in the process in which the plug member 205 is pulled out, portions of the side surface of the plug member 205 which are located at the liquid wiping portions 110 are deformed toward the liquid wiping portions 110. Consequently, the ink 108 adhering to the plug member 205 is wiped off by the liquid wiping portions 110. As a result, an amount of the ink 108 adhering to the back surface 107 of the plug member 205 decreases to be smaller than in the case of the first embodiment (FIG. 8C).

Third Embodiment

Next, a description will be given of the third embodiment of the present invention. Note that, in the following description, the same components as those in the first and second embodiments are given the same reference numerals, and a detailed description thereof is omitted. In the present embodiment, in a cross section illustrated in FIG. 9A, liquid wiping portions 210 each having a protruding shape are formed instead of the liquid wiping portions 110 in the second embodiment. The liquid wiping portions 210 are formed on the same side as that with the back surface lowest point 107A when viewed from the axial line 105CP of the plug member 205. Note that, in FIG. 9A, the liquid wiping portions 210 are formed at two positions on a plug member 305, but it may also be possible that the liquid wiping portion 210 is formed at one position or the liquid wiping portions 210 are formed at a plurality of positions.

Figure 9A:
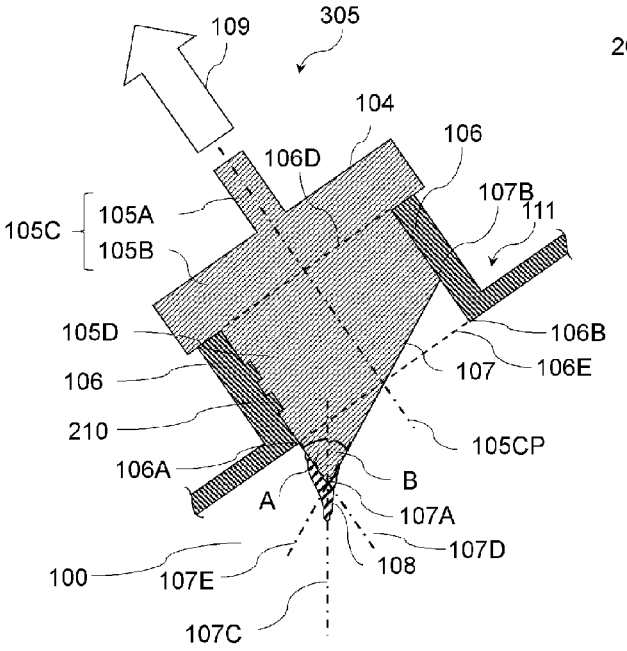
FIGS. 9A to 9C each are a cross-sectional view illustrating a plug member according to a third embodiment.
Figure 9B:
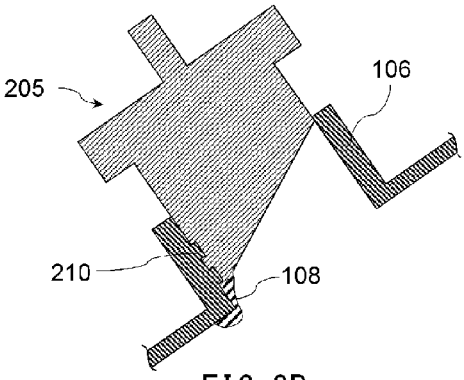
Figure 9C:
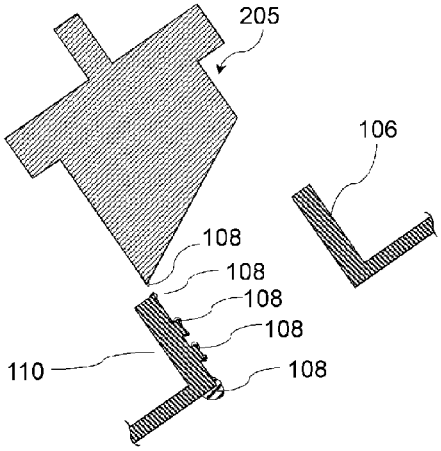

FIGS. 9B and 9C are diagrams sequentially illustrating a process in which the plug member 305 in the state in FIG. 9A is pulled out of the supply port 106, similarly to FIGS. 8B and 8C. In the state in FIG. 9A, when the user pulls the knob portion 105A in the direction of the arrow 109, the plug member 305 begins to be pulled out. At this time, the plug member 305 moves in the direction of the arrow 109 with the side surface of the plug portion 105D rubbing against the inner peripheral surface of the supply port 106 and against the liquid wiping portions 210 formed at the inner peripheral surface. Since the plug member 305 is attached to the supply port 106 while being elastically deformed, in the process in which the plug member 305 is pulled out, portions of the side surface of the plug member 305 which are located at the liquid wiping portions 210 are deformed toward the liquid wiping portions 210. Consequently, the ink 108 adhering to the plug member 305 is wiped off by the liquid wiping portions 210. As a result, an amount of the ink 108 adhering to the back surface 107 of the plug member 305 decreases to be smaller than in the case of the first embodiment (FIG. 9C).

Fourth Embodiment

Next, a description will be given of the fourth embodiment of the present invention. Note that, in the following description, the same components as those in the first to third embodiments are given the same reference numerals, and a detailed description thereof is omitted. In the present embodiment, in a cross section illustrated in FIG. 10A, a plug member 405 includes a knob portion 405A. The knob portion 405A is formed so as to protrude from a covering portion 405B of the plug member 405 in a direction parallel to an upper surface 404. In the cross section in FIG. 10A, on a side opposite to the knob portion 405A with respect to a covering portion center line 405CP of the plug member 405, a supporting portion 405E capable of connecting the covering portion 405B and a member other than the plug member 405 is formed. The connection of the supporting portion 405E to the member other than the plug member 405 can prevent the plug member 405 from falling out of the container body 111 and the liquid ejection apparatus 200. Examples of the member connected to the supporting portion 405E include a wire connecting the supporting portion 405E to the container body 111. As long as it is possible to prevent the plug member 405 from falling out, various modes can be used for the connection of the supporting portion 405E to the other member.

Figure 10A:
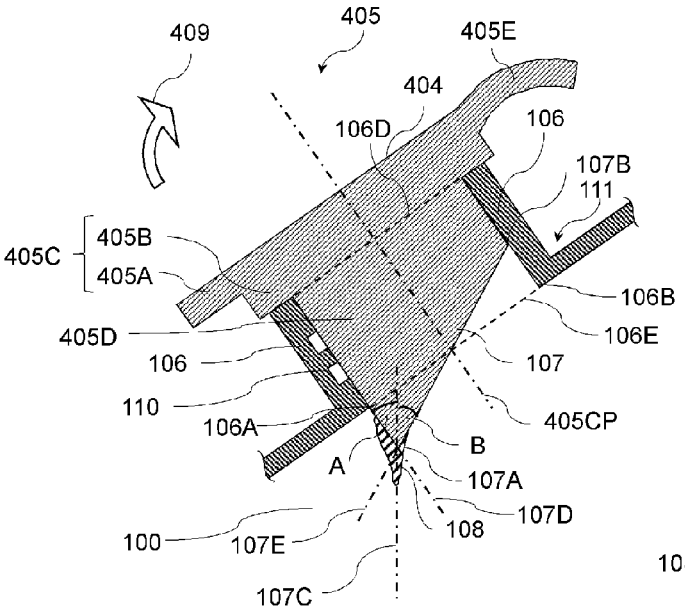
FIGS. 10A to 10C each are a cross-sectional view illustrating a plug member according to a fourth embodiment.
Figure 10B:
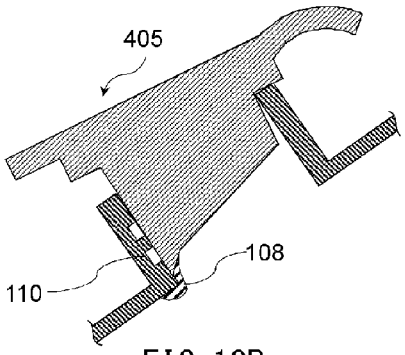
Figure 10C:
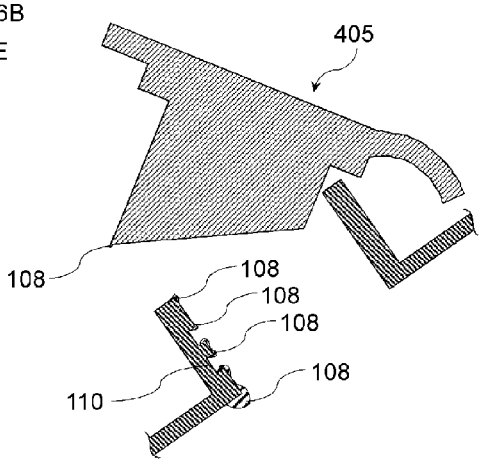
Figure 11:
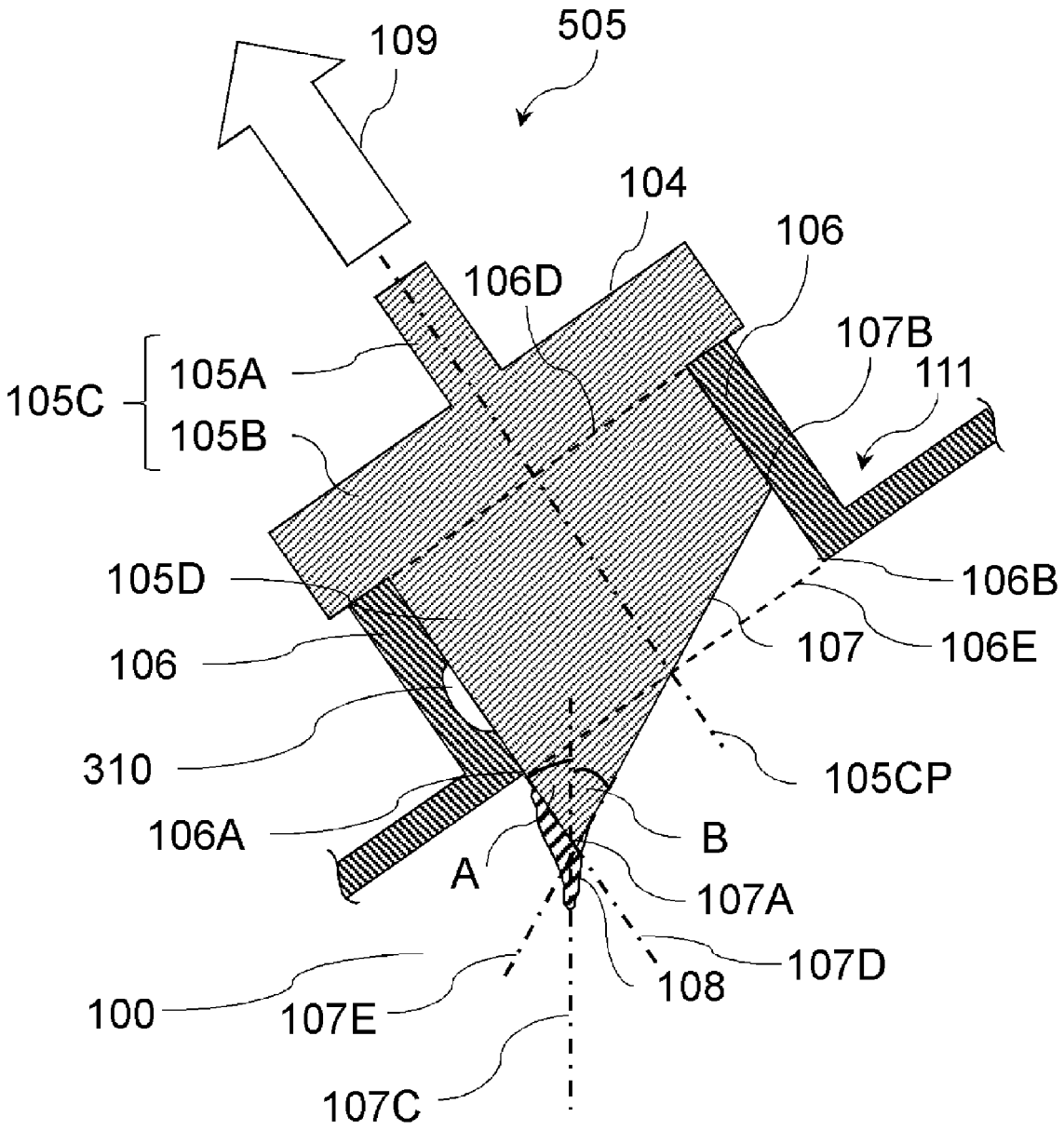
FIG. 11 is a cross-sectional view illustrating a plug member according to a modification.
Figure 12:
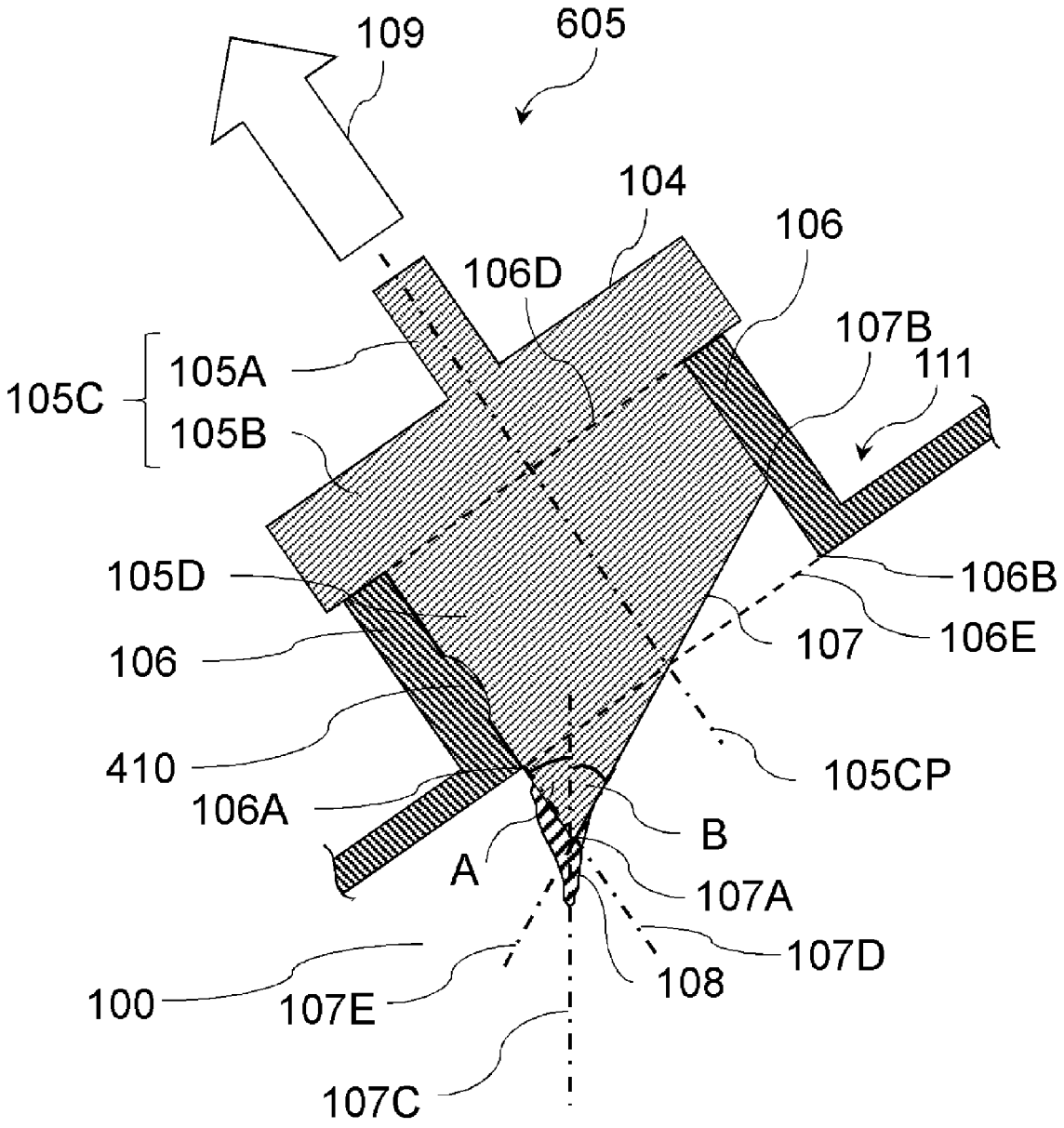
FIG. 12 is a cross-sectional view illustrating another plug member according to the modification.

FIGS. 10B and 10C are diagrams sequentially illustrating a process in which the plug member 405 in a state in FIG. 10A is pulled out of the supply port 106, similarly to FIGS. 6B and 6C. In the state in FIG. 10A, when the user pulls the knob portion 405A in a direction of an arrow 409 (rotation direction), the plug member 405 begins to be pulled out. At this time, the plug member 405 moves in the direction of the arrow 409 with a side surface of a plug portion 405D rubbing against the inner peripheral surface of the supply port 106 and against the liquid wiping portions 110 formed in the inner peripheral surface (FIG. 10B). Since the plug member 405 is attached to the supply port 106 while being elastically deformed, in the process in which the plug member 405 is pulled out, portions of the side surface of the plug member 405 which are located at the liquid wiping portions 110 are deformed toward the liquid wiping portions 110. Consequently, when the plug member 405 is pulled out in the direction of the arrow 409, the ink 108 adhering to the plug member 405 is wiped off by the liquid wiping portions 110. As a result, an amount of the ink 108 adhering to the back surface 107 of the plug member 405 decreases to be smaller than in the case of the first embodiment (FIG. 10C).

As described above, with the liquid ejection apparatus according to each of the embodiments, it is possible to provide a liquid container capable of reducing a possibility that, when a plug member of the liquid container is pulled out to open the container, a liquid is scattered or adheres to a hand of a person, and a liquid ejection apparatus including the container.

While the embodiments related to the technology disclosed in the present application have been described heretofore, the description of the embodiments made above is merely an example for describing the technology disclosed in the present application, and the technology disclosed in the present application can be implemented by appropriately modifying or combining the embodiments within a scope not departing from the gist of the invention. A description will be given of a modification of the embodiments describe above.

First Modification

The liquid wiping portions 110 or 210 in the embodiments described above are not limited to the shapes described above, and may appropriately have any shapes which allow the plug member to be deformed and rub against the inner peripheral surface of the supply port 106 in the process in which the plug member is pulled out of the supply port 106. For example, the liquid wiping portions 110 and 210 may also have such R-shaped shapes as those of liquid wiping portions 310 illustrated in FIG. 11 and liquid wiping portions 410 illustrated in FIG. 12. The shapes of the liquid wiping portions may be selectively determined appropriately on the basis of materials forming the plug member and the wall portion of the supply port, hardnesses thereof, and the like.

When the respective shapes of the liquid wiping portions in the embodiments described above and the present modification are compared to each other, the liquid wiping portions having the depressed shapes such as those in the second and fourth embodiments provide the frictional force between the plug member and the inner peripheral surface of the supply port which is smaller than when the liquid wiping portions have the protruding portions. Accordingly, from the viewpoint of ease of unplugging the plug member, the liquid wiping portions preferably have the depressed shapes. Meanwhile, when the liquid wiping portions have the protruding shapes, the frictional force between the plug member and the inner peripheral surface of the supply port is larger than when the liquid wiping portions have the depressed shapes, but an effect of wiping off an accordingly larger amount of the ink is obtained. With regard to whether the liquid wiping portions are to have R-shaped shapes or angular shapes also, it can be said that, when importance is given to the ease of unplugging the plug member, the liquid wiping portions preferably have the R-shaped shapes and, when importance is given to the amount of the ink to be wiped off, the liquid wiping portions preferably have the angular shapes.

According to the present modification also, by providing the back surface 107 of each of the plug members 505 and 605 with inclination, the adhering ink 108 is likely to collect at a specified location (e.g., the back surface lowest point 107A). The collected ink 108 is wiped off by the liquid wiping portions 310 and 410 formed in and at the inner peripheral surface of the supply port 106, and an amount of the ink wiped off is larger than that when no liquid wiping portion is formed. Accordingly, it is possible to provide a liquid container that can reduce the possibility that, when the plug member of the liquid container is pulled out to open the liquid container, the liquid scatters or adheres to a hand of a person, and a liquid ejection apparatus including the container.

With the technology disclosed in the present application, it is possible to provide the liquid container that can reduce the possibility that the liquid is scattered from the liquid container and the possibility that the liquid from the plug member adheres to a hand of a person, and the liquid ejection apparatus including the liquid container.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-072461, filed on Apr. 22, 2021, which is hereby incorporated by reference herein in its entirety.

What is claimed is:

1. A liquid container comprising:

a container body including a storage chamber configured to store a liquid and a supply port configured to supply the liquid to the storage chamber; and a plug member configured to be detachable from the container body so as to seal the supply port, the plug member including a body portion located outside the storage chamber and the supply port in the container body in an attached state where the plug member is attached to the container body and a plug portion located inside the storage chamber and the supply port in the attached state, wherein the plug portion has a press-fitted portion to be press-fitted into the supply port in the attached state and a leading end portion exposed to the storage chamber on a leading end side of the press-fitted portion in the attached state, in the attached state, an axial line of the plug portion is perpendicular to an opening surface of the supply port, and in the attached state, a leading end surface of the leading end portion is an inclined surface inclined with respect to a surface of the plug portion which is perpendicular to the axial line, and the inclined surface is inclined such that a side of the inclined surface located below in a vertical direction protrudes, in a direction of the axial line, from a side of the inclined surface located above in the vertical direction.

2. The liquid container according to claim 1, wherein the plug portion has a generally cylindrical shape and an outer peripheral surface including a first region to be press-fitted into the supply port and a second region exposed to the storage chamber on the leading end side of the first region, the press-fitted portion is the first region, and the leading end portion includes the second region and the leading end surface.

3. The liquid container according to claim 1, wherein the supply port is formed of:

an outer opening that is open to the outside of the container body;

an inner opening that is open into the storage chamber; and an inner peripheral surface connecting the outer opening and the inner opening, and the inner opening is located below the outer opening.

4. The liquid container according to claim 3, wherein, in the attached state, a gravity direction lowest point of the inclined surface is located below a gravity direction lowest point at the inner peripheral surface of the supply port in a gravity direction.

5. The liquid container according to claim 3, wherein, when it is assumed that, in a cross section along a vertical direction including the axial line of the plug portion in the attached state, an angle formed between a first virtual line connecting a lowest end point of the leading end surface and a point of contact with a lowest end point of the inner opening at the leading end portion and a vertical virtual line extending upward from the lowest end point of the leading end surface in the vertical direction is A and an angle formed between a second virtual line connecting the lowest end point of the leading end surface and a highest end point of the leading end portion and the vertical virtual line is B, $A \geq B$ is satisfied.

6. The liquid container according to claim 3, wherein the supply port has a liquid wiping portion that slidably moves against a region of the leading end portion of the plug portion in the attached state which is located on a side of the storage chamber rather than on a side of the supply port to wipe off the liquid when the plug member is detached from the container body.

7. The liquid container according to claim 6, wherein the liquid wiping portion is a portion having a depressed shape or a protruding shape provided in a region of the inner peripheral surface forming the supply port which is located at least below in the vertical direction.

8. The liquid container according to claim 3, wherein the body portion of the plug member includes:

a covering portion that comes into contact with an edge portion of the outer opening of the supply port;

a supporting portion connecting the covering portion to another member other than the plug member; and a protruding portion protruding from the covering portion outside the container body, the supporting portion is provided on an upper side of the covering portion in the vertical direction, and the protruding portion is provided on a lower side of the covering portion in the vertical direction.

9. A liquid ejection apparatus comprising:

a liquid ejection head that ejects a liquid; and the liquid container according to claim 1.

10. The liquid ejection apparatus according to claim 9, further comprising:

an apparatus main body in which the liquid container is embedded.

11. The liquid ejection apparatus according to claim 10, wherein, in a state where the liquid container is embedded in the apparatus main body, the plug member is detached from the supply port to allow the liquid to be supplied from the supply port into the storage chamber.

* * * * *